US011168460B1

(12) United States Patent
Karam et al.

(10) Patent No.: US 11,168,460 B1
(45) Date of Patent: Nov. 9, 2021

(54) SELF-PROPELLED PAVEMENT MATERIAL PLACING MACHINE AND METHODS FOR BACKFILLING MICRO-TRENCHES

(71) Applicant: MK-1 Construction Services, LLC, San Antonio, TX (US)

(72) Inventors: Paul A. Karam, San Antonio, TX (US); Carlos Medina, San Antonio, TX (US); Stanley R. Peters, Castle Rock, CO (US); David S. Zuniga, San Antonio, TX (US)

(73) Assignee: J&P INVESCO LLC, Schertz, TX (US)

( * ) Notice: Subject to any disclaimer, the term of this patent is extended or adjusted under 35 U.S.C. 154(b) by 0 days.

(21) Appl. No.: 16/577,903

(22) Filed: Sep. 20, 2019

Related U.S. Application Data

(63) Continuation of application No. 15/967,124, filed on Apr. 30, 2018, now Pat. No. 10,443,211.
(Continued)

(51) Int. Cl.

| | |
|---|---|
| ***E01C 19/00*** | (2006.01) |
| ***E02F 5/12*** | (2006.01) |
| ***E02F 3/96*** | (2006.01) |
| ***E01C 23/09*** | (2006.01) |
| ***E02F 5/22*** | (2006.01) |
| *E01C 19/26* | (2006.01) |

(52) U.S. Cl.
CPC ..... *E02F 5/12* (2013.01); *E01C 23/0966* (2013.01); *E02F 3/967* (2013.01); *E02F 5/226* (2013.01); *E01C 19/266* (2013.01)

(58) Field of Classification Search
CPC E02F 3/9675; E02F 5/12; E02F 5/226; E01C 19/266; E01C 23/0966
USPC ..... 404/104, 122
See application file for complete search history.

(56) References Cited

U.S. PATENT DOCUMENTS 69,611 A * 10/1867 Ballard ..... E01C 19/26 404/122
430,575 A * 6/1890 Griffin ..... E01C 19/26 404/122

(Continued)

FOREIGN PATENT DOCUMENTS

EP 1103533 5/2001
GB 2158491 * 5/1985 ..... E02F 5/12

OTHER PUBLICATIONS

ConcreteProducts.com, "Mixer measures up to grout, flowable till production", Aug. 2018, 1 page.

(Continued)

*Primary Examiner* — Raymond W Addie
(74) *Attorney, Agent, or Firm* — Merchant & Gould P.C.

(57) ABSTRACT

A machine for backfilling pavement material into a trench defined within a pavement surface includes a frame defining a longitudinal axis and having at least one wheel. The frame being configured to move along the pavement surface. A hopper supported on the frame and including an inlet opening configured to receive pavement material and an outlet opening configured to discharge pavement material into the trench. The machine also includes a compactor supported on the frame and aligned with the hopper along the longitudinal axis. The compactor is configured to compact the discharged pavement material within the trench.

18 Claims, 10 Drawing Sheets

Related U.S. Application Data

(60) Provisional application No. 62/491,994, filed on Apr. 28, 2017.

(56) References Cited

U.S. PATENT DOCUMENTS 1,012,612 A * 12/1911 Da Vier ..... E01C 19/26 404/122
1,545,167 A * 7/1925 Opitz ..... B62D 49/0664 180/21
3,024,930 A 3/1962 Sims
3,043,200 A 7/1962 Huttash
3,111,335 A 11/1963 Hickman
3,130,652 A * 4/1964 Newton, Jr. ..... E01C 23/098 404/107
3,469,824 A 9/1969 Futty
3,572,652 A 3/1971 Hale
3,580,147 A 5/1971 Kaltenegger
3,820,914 A 6/1974 Zimmerman
4,036,564 A 7/1977 Richards
4,085,976 A 4/1978 Edwards
4,211,491 A 7/1980 Chaney
4,437,766 A 3/1984 Joachim
4,630,965 A 12/1986 Nguyen
4,781,556 A 11/1988 Paul
5,609,836 A 3/1997 McManus
5,667,298 A 9/1997 Musil
5,795,060 A 8/1998 Stephens
5,971,656 A 10/1999 Kitsmiller
6,109,826 A 8/2000 Mertes
6,290,428 B1 9/2001 Hall
6,439,806 B1 8/2002 Dillingham
6,942,717 B2 9/2005 Armstrong
7,080,955 B2 7/2006 Gregg
7,255,512 B2 8/2007 Wallace
7,410,322 B1 8/2008 Wallace
8,747,547 B1 6/2014 Peters et al.
8,882,905 B1 11/2014 Peters et al.
9,376,343 B2 6/2016 Hernandez et al.
9,486,938 B2 11/2016 Pino
9,816,237 B2 11/2017 Loomis
10,443,211 B2 10/2019 Karam
10,571,045 B2 2/2020 Pino, Jr. et al.
10,571,047 B2 2/2020 Pino, Jr. et al.
10,641,414 B2 5/2020 Pino, Jr. et al.
2003/0142579 A1 7/2003 Throop
2007/0171764 A1 7/2007 Klein
2016/0138810 A1 5/2016 Owen
2016/0257620 A1 9/2016 Peters et al.
2017/0080601 A1 3/2017 Hernandez
2018/0038071 A1* 2/2018 Jurgens ..... H02G 1/06
2018/0106015 A1 4/2018 Pino et al.
2018/0126592 A1 5/2018 Karam
2018/0156357 A1 6/2018 Pino et al.
2018/0313059 A1 11/2018 Karam et al.
2020/0149659 A1 5/2020 Pino, Jr. et al.
2020/0149660 A1 5/2020 Pino, Jr. et al.
2020/0200292 A1 6/2020 Pino, Jr. et al.
2020/0406501 A1 12/2020 Hernandez

OTHER PUBLICATIONS

Bay Lynx Website, "Bay-Lynx Develops Game-Changing Grout Mixer", found online at: https://bay-lynx.com/news/bay-lynx-develops-game-changing-grout-mixer/, May 15, 2018, 4 pages.

* cited by examiner

SELF-PROPELLED PAVEMENT MATERIAL PLACING MACHINE AND METHODS FOR BACKFILLING MICRO-TRENCHES

RELATED APPLICATIONS

This application is a continuation of U.S. patent application Ser. No. 15/967,124, filed Apr. 30, 2018, now U.S. Pat. No. 10,443,211, which claims the benefit of U.S. Provisional Application No. 62/491,994, filed Apr. 28, 2017, entitled "SELF-PROPELLED PAVEMENT MATERIAL PLACING MACHINE AND METHODS FOR BACKFILLING MICRO-TRENCHES," which are hereby incorporated by reference in their entirety.

INTRODUCTION

Installation of cables and conduits, for example, fiber optic communication cables or other utility cables, under road or walkway surfaces may involve the excavation of small trenches (sometimes referred to as nano or micro trenches) through existing pavement surfaces and subgrade. The desired cable or conduit may then be installed and afterwards the trench is backfilled and repaired up to the layer of pavement structure with a backfill pavement material mixture. By only excavating what is required for the cable or conduit, large expanses of cable or conduit can be quickly installed. These small trenches, however, are difficult to repair quickly because of the narrow size and close working conditions typically involved.

Traditional equipment and methods for repairing wide trenches with backfill mixtures are generally too large for use with small trenches. For example, one machine is typically used to place the backfill mixture within the trench and a different machine, or set of machines, is used to compact the backfill material within the trench and/or screed the compacted material with the road or walkway surface. As such, a large clean-up of the area is often required before it can be re-opened to traffic. Accordingly, time-efficient equipment and methods are needed to repair small trenches and reduce construction interruptions.

Self-Propelled Pavement Material Placing Machine and Methods for Backfilling Micro-Trenches This disclosure describes self-propelled pavement material placing machines and methods of backfilling and repairing trenches. The machines include a hopper with a paddle assembly that can break-up and place the pavement material within the trench. The hopper is supported on a frame that has a drive wheel, so that the hopper can be self-propelled along the trench and continuously backfill the pavement material. Also supported on the frame, the machine includes a compactor that follows along the trench and compacts the pavement material placed into the trench. The compactor may be a weighted wheel and/or include active compaction systems, such as a vibratory compactor or a hydraulic compactor.

In one aspect, the technology relates to a machine for backfilling pavement material into a trench defined within a pavement surface, the machine including: a frame defining a longitudinal axis and including at least one wheel, wherein the frame is configured to move along the pavement surface; a hopper supported on the frame, wherein the hopper includes an inlet opening configured to receive pavement material and an outlet opening configured to discharge pavement material into the trench; and a compactor supported on the frame and aligned with the hopper along the longitudinal axis, wherein the compactor is configured to compact the discharged pavement material within the trench.

In an example, the machine further includes a paddle assembly disposed at least partially within the hopper and proximate the outlet opening, wherein the paddle assembly is configured to agitate the pavement material and/or place the pavement material into the trench. In another example, the paddle assembly includes a rotatable shaft and a disk coupled to the shaft, and the disk comprises a plurality of circumferentially spaced teeth positioned at least partially within the outlet opening. In yet another example, the disk at least partially extends into the trench when the hopper is above the trench, and the disk is configured to at least partially compact the pavement material within the trench. In still another example, the machine further includes a motor coupled to the shaft and configured to rotate the shaft, wherein the shaft defines a rotational axis that is substantially orthogonal to the longitudinal axis. In an example, the machine further includes at least one auger disposed at least partially within the hopper, and the at least one auger is configured to channel the pavement material towards the outlet opening.

In another example, the compactor includes a weighted wheel. In yet another example, the weighted wheel includes a circumferential flange configured to extend at least partially into the trench when compacting the pavement material. In still another example, the machine further includes a compactor frame configured to support the weighted wheel, wherein the compactor frame is pivotally coupled to the frame. In an example, the compactor includes at least one of a vibrating compactor and a hydraulic compactor. In another example, the hopper is adjustable relative to the frame so that the outlet opening is selectively positionable in height over the trench.

In yet another example, the outlet opening extends along the longitudinal axis and includes a downstream end, and wherein a cover at least partially surrounds the downstream end for directing the discharged pavement material into the trench. In still another example, the at least one wheel includes a drive wheel configured to propel the machine along the pavement surface and a guide wheel configured to guide the machine along the trench. In an example, the drive wheel and the guide wheel both align along the longitudinal axis with the hopper and the compactor. In another example, the guide wheel is freely turnable about a turn axis that is substantially orthogonal to the longitudinal axis. In yet another example, the machine further includes a motor coupled to drive wheel and configured to rotate the drive wheel and propel the machine along the pavement surface. In still another example, the hopper is positioned between the drive wheel and the guide wheel along the longitudinal axis.

In another aspect, the technology relates to a method of backfilling pavement material into a trench defined within a pavement surface, the method including: moving a machine along the trench, wherein the machine includes a frame and at least one wheel; receiving the pavement material in a hopper supported on the frame; discharging the pavement material from an outlet opening of the hopper into the trench as the machine moves along the trench; and after the pavement material is placed within the trench, compacting the pavement material within the trench as the machine moves along the trench.

In an example, discharging the pavement material from the hopper includes agitating the pavement material via a rotatable paddle assembly and placing the pavement material into the trench by the rotatable paddle. In another example, receiving the pavement material in the hopper includes channeling the pavement material from a mobile volumetric mixing system.

These and various other features as well as advantages which characterize the self-propelled pavement material placing machines and methods described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure particularly pointed out in the written description and claims hereof as well as the appended drawings.

It is to be understood that both the foregoing introduction and the following detailed description are exemplary and explanatory and are intended to provide further explanation of the invention as claimed.

BRIEF DESCRIPTION OF THE DRAWINGS

The following drawing figures, which form a part of this application, are illustrative of described technology and are not meant to limit the scope of the invention as claimed in any manner, which scope shall be based on the claims appended hereto.

DETAILED DESCRIPTION

Before the machines and methods that are the subject of this disclosure are described, it is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting. It must be noted that, as used in this specification, the singular forms "a," "an," and "the" include plural referents unless the context clearly dictates otherwise.

This disclosure describes self-propelled pavement material placing machines and methods of backfilling and repairing trenches. The machines include a hopper with a paddle assembly that can break-up and place the pavement material within the trench. The hopper is supported on a frame that has a drive wheel, so that the hopper can be self-propelled along the trench and continuously backfill the pavement material. Also supported on the frame, the machine includes a compactor that follows along the trench and compacts the pavement material placed into the trench. The compactor may be a weighted wheel and/or include active compaction systems, such as a vibratory compactor or a hydraulic compactor. The machine (e.g., the hopper and the compactor) enable pavement material to be more quickly placed within narrow trenches and compacted therein, while reducing or eliminating the clean-up required after the trench is repaired. Furthermore, the machine enables a single piece of equipment to make one pass over the trench for the backfill and repair of the pavement surface. This enables for smaller trenches to be more quickly repaired and reduces construction closure times.

Figure 1:
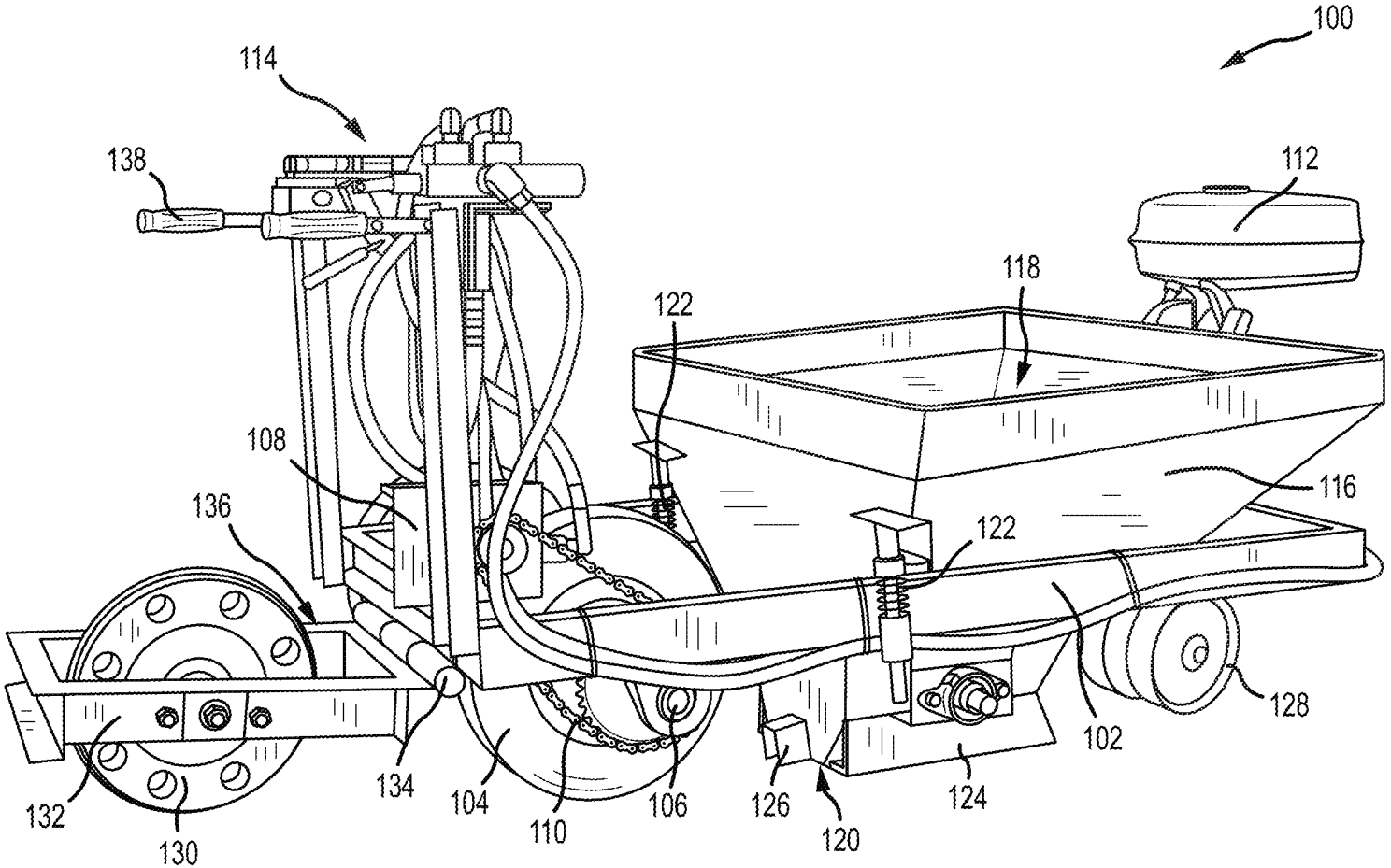
FIG. 1 is a perspective view of an exemplary machine for backfilling pavement material into a trench.

Although the designs and technology introduced above and discussed in detail below may be implement on a variety of mobile platforms (e.g., vehicle, trailer, skid, railcar, marine vessel, etc.), the present disclosure will discuss the implementation of this technology in the form of a hopper mounted on a mobile frame, as illustrated in FIG. 1. It is appreciated that the technology described in the context of the exemplary machines could be adapted for use with any other mobile platform including a trailer, a skid, and a railcar to name but a few.

FIG. 1 is a perspective view of an exemplary machine 100 for backfilling pavement material into a trench. In the example, the trench may be a nano trench that is approximately ½ inch wide and 3-4 inches in depth, or a micro trench that is approximately 2 inches in width and 12-16 inches in depth. Due to the small sizes of the trench, placing pavement material into the trench is a more detailed and time consuming process than backfilling wider trenches. In alternative examples, the trench may have any other size as required or desired.

The machine 100 includes a frame 102 supporting a drive wheel 104 so that the machine 100 may move along a pavement surface. The drive wheel 104 is rotatable about an axle 106 that is rotatably mounted to the frame 102. A first motor 108 is also mounted on the frame 102 and is coupled to the drive wheel 104 through a transmission 110 (e.g., a chain or a cable and corresponding sprockets). The first motor 108 may drive rotation of the drive wheel 104 in a forward or a backward direction as required or desired for propelling movement of the machine 100. The first motor 108 may be a hydraulic motor that is coupled to a hydraulic fluid system 112 disposed on the frame 102. The hydraulic fluid system 112 may include a combustion engine that powers one or more pumps, hydraulic motors, and/or reservoirs connected via hydraulic lines. Control of the first motor 108, for example, the speed and direction of the machine 100, may be enabled by an operator control station 114 positioned above the drive wheel 104. This location enables the operator to observe the discharge of the pavement material while controlling movement of the machine 100. In other examples, the frame 102 may be towed behind, or pushed by, a vehicle such that the drive system is not required.

The frame 102 also supports a hopper 116 configured to receive pavement material for backfilling the trench. In the example, the hopper 116 may have a hollow pyramidal frustum shape with an inlet opening 118 configured to receive pavement material and an outlet opening 120 configured to discharge the pavement material to the trench. The inlet opening 118 may be substantially rectangular and have a larger cross-sectional area than the outlet opening 120 that is also substantially rectangular. This configuration enables easier receipt of pavement material while also enabling the pavement material to be directly placed into the trench and not overflowing onto the pavement surface next to the trench, thereby reducing or eliminating the clean-up needed during the backfilling process. In other examples, the hopper 116 may have any size or shape that enables the machine 100 to function as described herein (e.g., a conical shape, a cylindrical shape, a trough shape, etc.)

The hopper 116 is coupled to the frame 102 by one or more struts 122. The struts 122 may be adjustable so that the outlet opening 120 of the hopper 116 can be positionable in height over the trench as required or desired. This enables for the pavement material to be discharged directly into the trench from the machine 100 and not overflow onto the surrounding pavement surface, thereby reducing the amount of clean-up required during the backfilling process. In the example, the strut 122 may be a coil spring over a shock to provide damping between the hopper 116 and the frame 102 so that the outlet opening 120 of the hopper 116 can remain positioned over the trench during operation. For example, vibration induced on the frame 102 (e.g., by the driving operation) and/or vibration induced on the hopper 116 (e.g., through the loading of pavement material) is reduced or eliminated from being transferred to the other component.

The outlet opening 120 of the hopper 116 is disposed below the inlet opening 118 and is configured to be oriented above the trench during backfilling operations. At least partially surrounding the outlet opening 120 is an adjustable side hopper 124 that extends from the sidewall of the hopper 116 towards the pavement surface. The side hopper 124 adjusts the width of the outlet opening 120 and enable the discharged pavement material to be immediately directed into the trench and reducing or eliminating the need for clean-up. A downstream end of the outlet opening 120 (e.g., in reference to the travel direction of the machine 100 during the backfilling process) may include a cover 126 that at least partially surrounds the downstream end. The cover 126 facilitates containing the discharged pavement material over the trench as the machine 100 moves during operation, thereby further reducing material overflow on the pavement surface. In some examples, at least partially surrounding the side hopper 124, a flexible curtain (not shown) may be provided to further contain the pavement material within the area directly around the trench and facilitate an easier clean-up after the backfill operation.

On the other side of the hopper 116 from the drive wheel 104, a guide wheel 128 is coupled to the frame 102 in an upstream direction. The guide wheel 128 is configured to extend at least partially into the trench and guide the machine 100 along the trench during movement therealong. The guide wheel 128 enables the machine 100 to follow along the trench and positions the hopper 116 directly over the trench for backfilling the pavement material. In the example, the guide wheel 128 is freely turnable about a turn axis relative to the frame 102 so that the guide wheel 128 can guide the machine 100 around curved sections of the trench. In some examples, the guide wheel 128 may include two wheels next to each other with a pin extending between. The pin may extend into the trench and guide the machine 100 along the length of the trench with the two wheels rolling on the pavement surfaces on either side of the trench. In other examples, the guide wheel 128 may be sized and shaped to extend at least partially into the trench to provide guidance to the machine 100. In still further examples, the guide wheel 128 may be a static shoe that extends into the trench and slides along therein.

The machine 100 also comprises a compactor 130 that is supported on the frame 102 and configured to compact the discharged pavement material within the trench for strength and stability, and to remove any voids in the pavement material. In the example, the compactor 130 is a weighted wheel that is rotatably supported by a compactor frame 132. The compactor frame 132 can be pivotally coupled to the frame 102 via a hinged connection 134. By enabling independent movement of the compactor 130 relative to the frame 102, the machine 100 can provide substantially uniform compaction of the pavement material within the trench even if the pavement surface includes varying undulations and slopes. To enable the machine 100 to work with multiple backfill mixtures and trench widths, the weighted wheel is replaceable. In one example, the weighted wheel may be a 300 pound wheel, although heavier or lighter weights may also be utilized as required or desired.

In operation, the compactor frame 132 defines an operator surface 136 that a machine operator may be supported on while operating the machine 100 through the control station 114. By positioning the operator over the weighted wheel, additional compaction weight is provided for compacting the backfilled pavement material. One or more handles 138 are also provided for the operator. In other examples, if additional compaction weight is required or desired, the compactor frame 132 may include an assembly (not shown) for attaching additional weights. For example, a post may be provided so that plated weights can be added to the compactor frame 132. In another example, a cage may be provided so that weight blocks can be added to the compactor frame 132.

As shown in FIG. 1 a passive weighted compactor 130 is illustrated and described. Additionally or alternatively, the compactor 130 may be a vibrating wheel compactor or a vibrating shoe compactor that compacts the backfilled pavement material within the trench. In another example, a hydraulic plate compactor may be used. Furthermore, more than one compactor 130 may be used for compaction of the pavement material within the trench, such as a vibrating shoe compactor followed by a weighted wheel compactor. After compaction of the pavement material, another operator may manually clean-up the trench area from any overflow pavement materials. In other examples, a V-spoon scoop (not shown) may be attached to the end of the compactor frame 132 to collect any overflow pavement materials.

The machine 100 is configured to receive pavement materials, place the pavement materials in the trench, and compact the pavement materials all in a single pass. This enables for quicker repair of the trench, for example, up to 5,000 linear feet of trench per day or more. As used herein, pavement materials may include, but are not limited to a cold asphalt mix (e.g., emulsifying asphalt in water), a cut-back asphalt mix (e.g., dissolving the binder in solvents), a warm asphalt mix, and/or a hot asphalt mix. However, other mixtures or materials may also be used, for example, ground up asphalt, ground concrete, aggregate minerals, and/or subgrade (e.g. native soils).

Figure 2A:
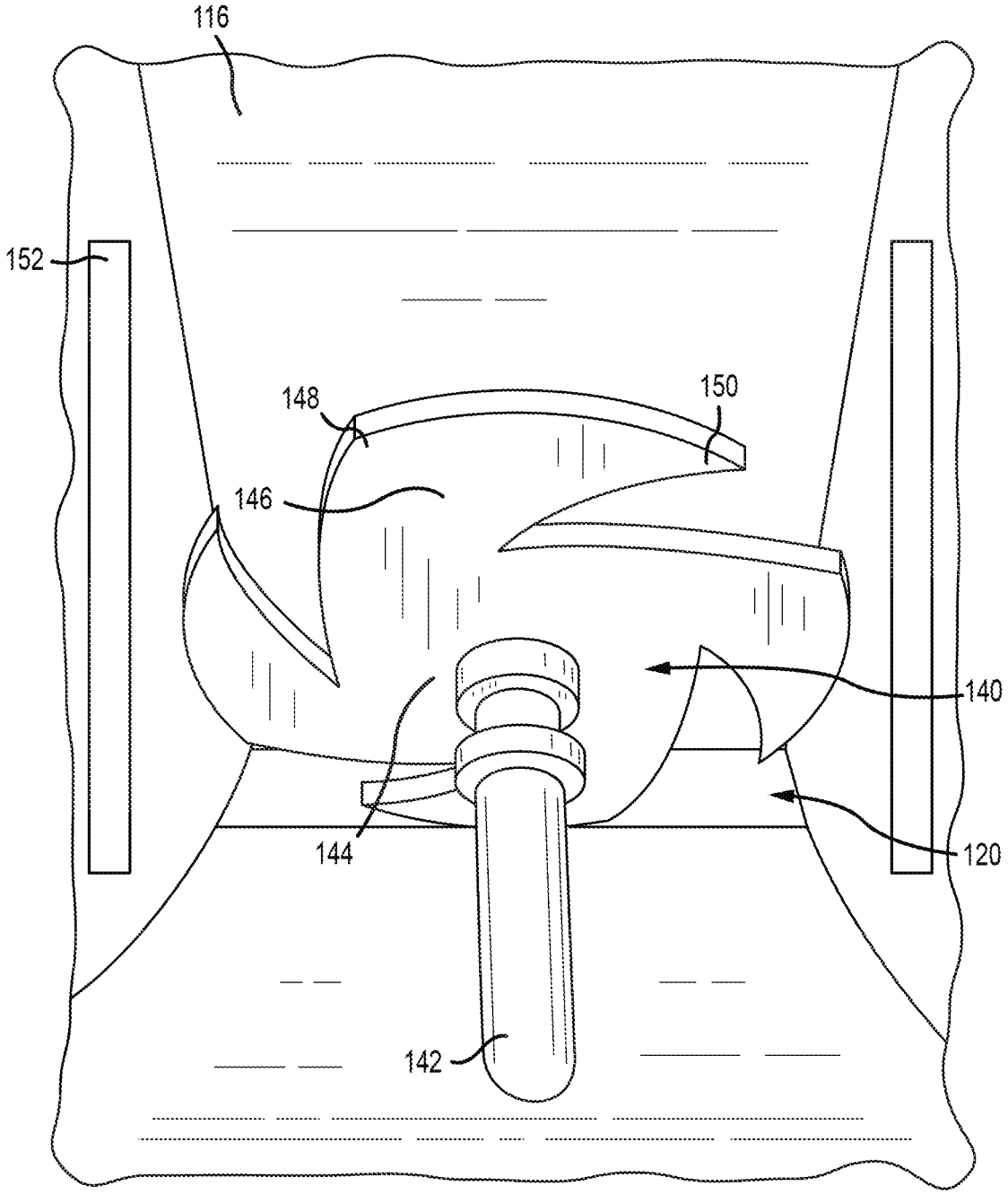
FIG. 2A is an interior view of a hopper of the machine shown in FIG. 1.

FIG. 2A is an interior view of the hopper 116 of the machine 100 (shown in FIG. 1). Pavement materials, such as asphalt, may aggregate into large chunks during transport, which are problematic for backfilling smaller size trenches. Rather, it is desirable to have pavement materials of consistent smaller sizes so that it may be more easily placed within the trench and fill the trench without inducing any voids. As such, a paddle assembly 140 may be disposed at least partially within the hopper 116 and proximate the outlet opening 120. The paddle assembly 140 is configured to agitate and break-up the large chunks of pavement materials so that the pavement material may be more easily be discharged into the trench. Additionally, the paddle assembly 140 may be configured to facilitate placing and at least partially compacting the pavement material in the trench to increase the strength and support of the repair material.

In the example, the paddle assembly 140 includes a rotatable shaft 142 mounted on the hopper 116 between the inlet opening and the outlet opening 120. Coupled to the shaft 142 is a modified disk 144 disposed at least partially within the outlet opening 120. The disk 144 includes a plurality of circumferentially spaced teeth 146, each having a heel 148 positioned proximate the shaft 142 and a tip 150 extending therefrom. The tip 150 is configured to agitate and break-up the large chunks of pavement materials while the heel 148 can place and compact the pavement material in the trench. The outlet opening 120 may be substantially rectangular in shape such that the teeth 146 can extend out of the outlet opening 120 and into the trench while in operation. The paddle assembly 140 position within the outlet opening 120 and the hopper 116 may also be adjustable. For example, the teeth 146 may be positionable to extend into the trench between 0.5 inches and 1.5 inches (shown in FIG. 2B) as required or desired. In alternative examples, the disk 144 can have any other configuration (e.g., teeth geometry, number of teeth, size, etc.) that enable the paddle assembly 140 to function as described herein. For example, the disk 144 may have a cog-like shape that breaks-up the pavement material, while also compacting it within the trench. In further examples, the disk 144 may also vibrate so as to assist in agitation and compaction of the pavement material.

The outlet opening 120 is sized and shaped to discharge appropriate amounts of pavement material per lineal foot along the trench. This enables the pavement material to be compacted as required or desired, and the final repair surface to be level with the existing pavement surface. Additionally, overflow of pavement material is reduced or eliminated so as to facilitate easier and quicker clean-up. The hopper 116 may also include one or more augers 152 disposed at least partially therein. The augers 152 are configured to channel the pavement material that is loaded into the hopper 116 towards the outlet opening 120 and the paddle assembly 140. For example, the augers 152 may be continuous-flite screw type augers, paddle type augers, or the like for controlling flow of the pavement material through the hopper 116. In other example, the hopper 116 may include a bin vibrator (not shown) that is configured to break-up the pavement material and channel it towards the outlet opening 120.

Figure 2E:
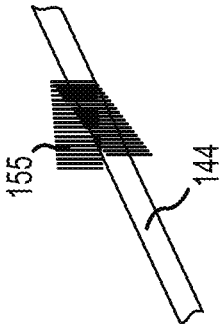
FIG. 2E is a partial enlarged view of FIG. 2D.
Figure 2D:
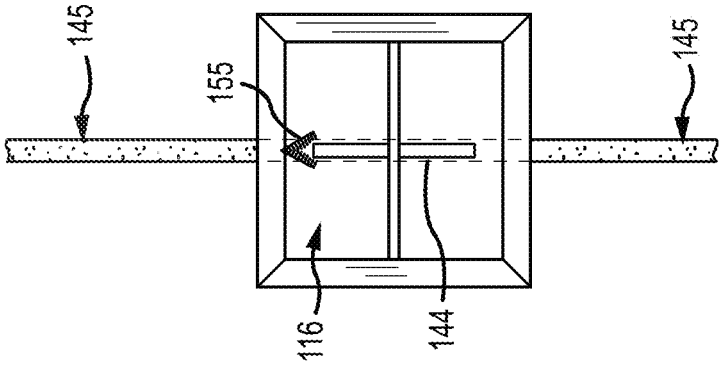
FIG. 2D is a top view of the hopper shown in FIG. 2A.
Figure 2B:
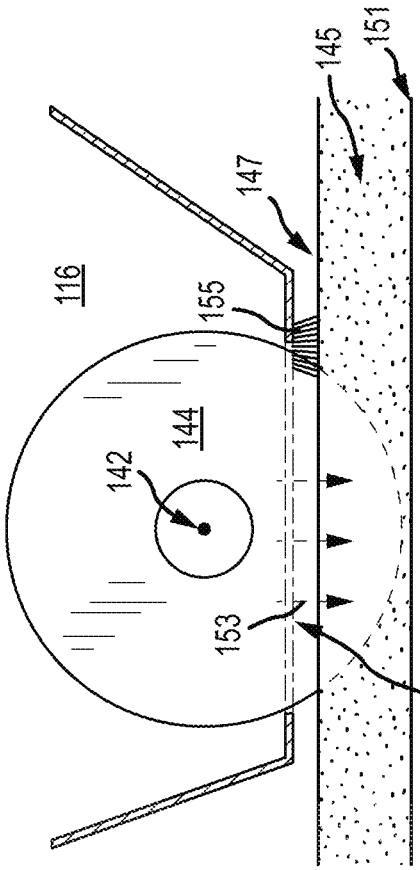
FIG. 2B is a side view of the hopper shown in FIG. 2A.
Figure 2C:
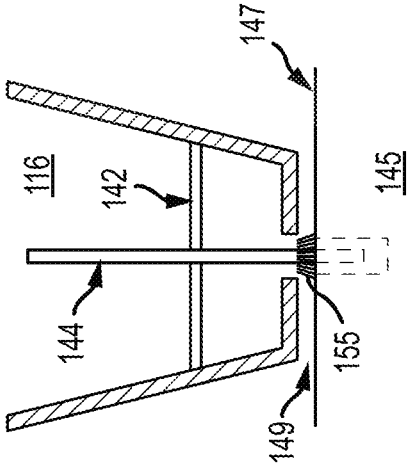
FIG. 2C is a front view of the hopper shown in FIG. 2A.

FIG. 2B is a side view of the hopper 116 shown in FIG. 2A. FIG. 2C is a front view of the hopper 116 shown in FIG. 2A. FIG. 2D is a top view of the hopper 116 shown in FIG. 2A. FIG. 2E is a partial enlarged view of FIG. 2D. Referring concurrently to FIGS. 2B-2E, the hopper 116 is illustrated as positioned over a trench 145 which is cut within a pavement surface 147. The outlet opening 120 of the hopper 216 is adjustably positioned above the pavement surface 147 such that a gap 149 is formed therebetween. The paddle assembly 140, including the disk 144 and the shaft 142, is rotatably disposed proximate the outlet opening 120. A portion of the disk 144 extends within the trench 145 and towards a bottom surface 151 of the trench 145. In operation, the disk 144 is configured to break-up the large chunks of the pavement material 153, while additionally placing and compacting the pavement material 153 in the trench 145.

In the example, the hopper 116 may also include a discharge sweeper 155 that extends from the bottom of the hopper 116, towards the pavement surface 147, and at least partially spanning the gap 149. The discharge sweeper 155 may be formed as a brush configured to sweep overflow pavement material 153 that ends up on the pavement surface 147 into the trench 145 before final compaction by the compactor. This reduces waste of the pavement material 153 and reduces or eliminates trench area clean-up after the trench 145 is repaired. The discharge sweeper 155 may be positioned on either side of the disk 144 in a V-shaped orientation. For example, each sweeper 155 is positioned at an approximately 45° angle in a direction towards the middle of the trench 145. In other examples, the angle of the discharge sweeper 155 may be greater than 45° so that a wider area of the pavement surface 147 can be swept. In further examples, the angle of the discharge sweeper 155 may be less than 45°. The discharge sweeper 155 is also positioned towards the downstream end of the outlet opening 120 (e.g., relative to the movement direction of the machine during repair). For example, the discharge sweeper 155 is positioned between the shaft 142 and the downstream end. In other examples, the discharge sweeper 155 may be a separate component that is positioned between the hopper 116 and the compactor. Additionally or alternatively, the discharge sweeper 155 may be a plate that plows the overflow pavement materials 153 back into the trench 145.

Figure 3:
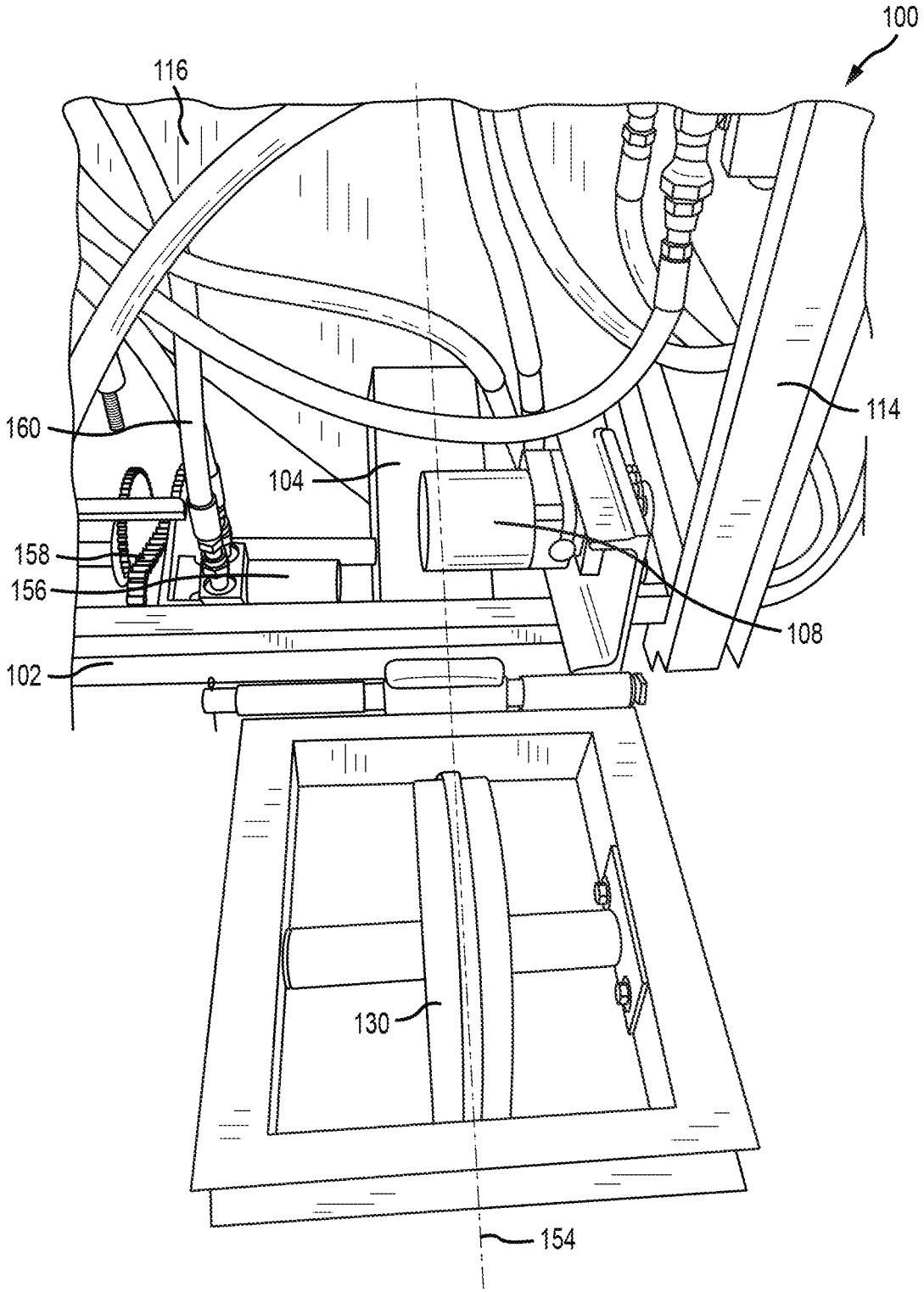
FIG. 3 is a partial top view of the machine shown in FIG. 1.

FIG. 3 is a partial top view of the machine 100. The frame 102 defines a longitudinal axis 154 that corresponds the position of the machine 100 over the trench. In the example, the hopper 116, the drive wheel 104, the compactor 130, and the guide wheel 128 (shown in FIG. 1) are aligned along the longitudinal axis 154 so that the machine 100 can backfill and compact the trench in a single pass. The outlet opening 120 (shown in FIG. 2A) of the hopper 116 also is elongated along the longitudinal axis 154.

The machine 100 may include a second motor 156 that is coupled to the shaft 142 of the paddle assembly 140 (shown in FIG. 2A) through a transmission 158 (e.g., a chain or a cable and corresponding sprockets). The second motor 156 may drive the shaft about its rotational axis as required or desired for agitating and/or compacting the pavement material that is discharged from the hopper 116 as described above. In the example, the rotational axis of the shaft may be substantially orthogonal to the longitudinal axis 154. The second motor 156 may be a hydraulic motor that is coupled to the hydraulic fluid system through one or more hydraulic lines 160. Similar to the first motor 108, control of the second motor 156, for example, the speed of the paddle assembly, may be enabled by the operator control station 114 positioned above the drive wheel 104. As illustrated independent motors 108, 156 are provided so as to provide independent control of the speed and movement of the machine and components therein. In other examples, a single power source may be used to provide independent control of the components as described herein.

The drive wheel 104 may be a rubber wheel configured to propel the machine 100 along the pavement surface. The drive wheel 104 is positioned between the hopper 116 and the compactor 130 and drives over the backfilled trench before final compaction by the compactor 130. As such, the drive wheel 104 may facilitate additional compaction of the pavement material discharged into the trench. In some examples, the drive wheel 104 may further include a vibratory compactor element to further facilitate additional compaction of the pavement material.

Figure 4:
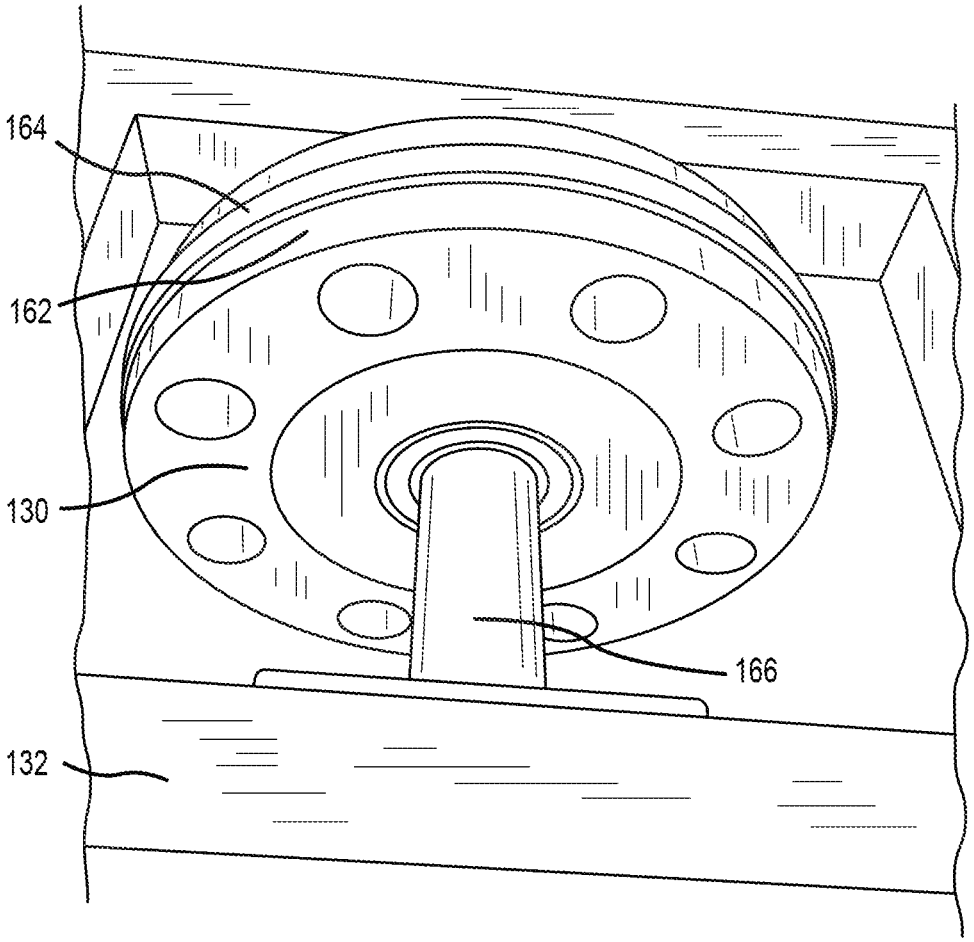
FIG. 4 is a perspective view of a compactor of the machine shown in FIG. 1.

FIG. 4 is a perspective view of the compactor 130 of the machine 100 (shown in FIG. 1). As illustrated, the compactor 130 includes a weighted wheel that has an outer circumferential plate 162 that surrounds the wheel and facilitates compaction of the pavement material within the trench. The plate 162 may include a circumferential flange 164 that extends outwards. The flange 164 is sized and shaped (e.g., thickness and width) to extend within the trench and enable compaction of the pavement material therein. For example, the width of the flange 164 may be sized slightly less than the width of the trench and the thickness of the flange may be sized to extend into the trench between 0.5 inches and 1.5 inches. The plate 162 and flange 164 component may be changed out as required or desired for different size trenches.

Additionally, the weighted wheel is mounted on an axle 166 such that the entire wheel may be changed out as required or desired for increasing or decreasing compaction weight. In some examples, the weighted wheel may further include a vibratory compactor element to further facilitate additional compaction of the pavement material within the trench. Before or after the compactor 130, a screeding element (not shown) may be coupled to the compactor frame 132 to screed the pavement material level and flush with the pavement surface.

Figure 5:
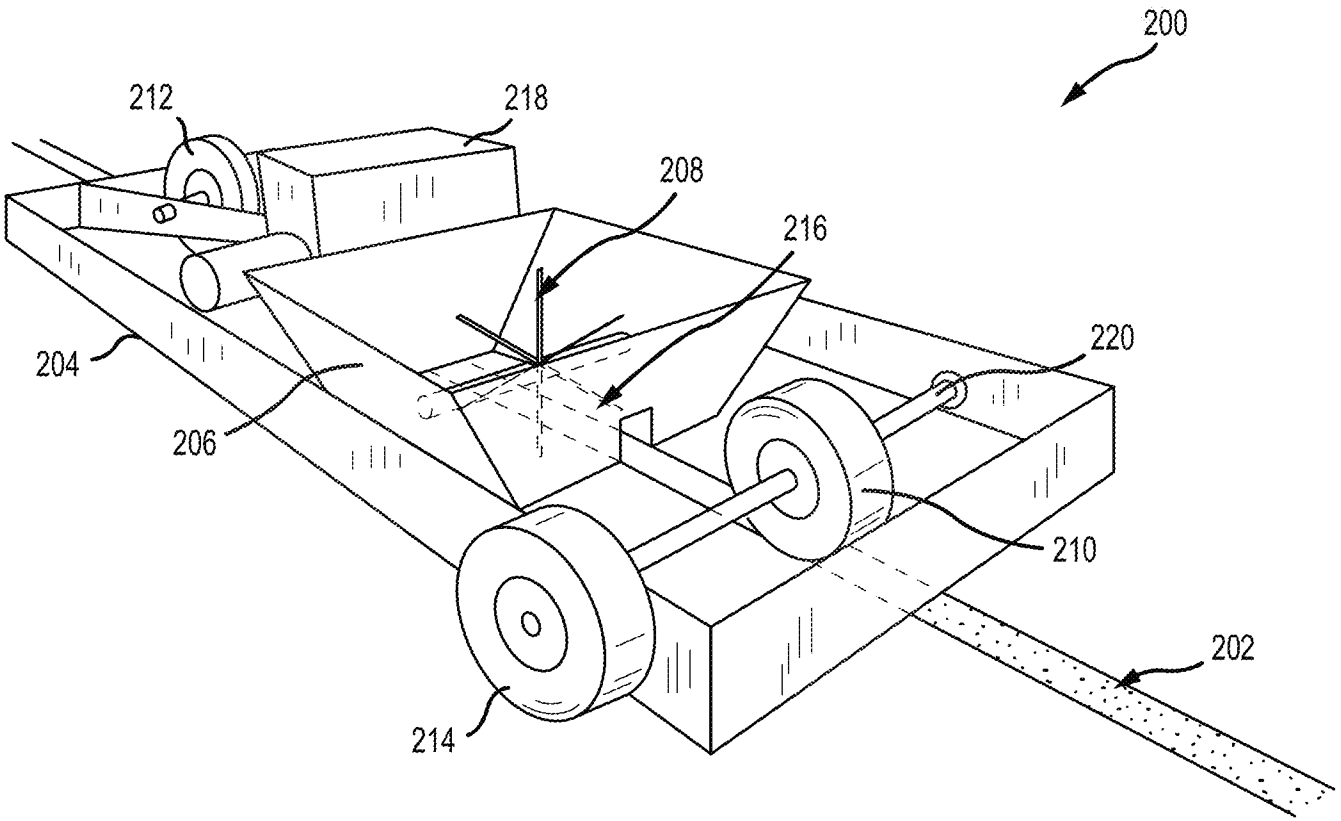
FIG. 5 is a perspective view of another configuration of a machine for backfilling pavement material into a trench.

FIG. 5 is a perspective view of another configuration of a machine 200 for backfilling pavement material into a trench 202. Similar to the example described above in FIGS. 1-4, the machine 200 is configured to receive pavement materials, place the pavement materials in the trench, and compact the pavement materials all in a single pass. The machine 200 includes a frame 204 that supports a hopper 206 having a paddle assembly 208, and a compactor 210. A guide wheel 212 is positioned towards the front (e.g., the direction with respect to travel of the machine 200 during backfill operations) of the frame 204 and a drive wheel 214 is positioned at the rear of the frame 204. In this example, the drive wheel 214 is offset from an outlet opening 216 of the hopper 206 so that the compactor 210 is positioned directly behind the hopper 206.

A power source 218 (e.g., a motor) is supported by the frame 204 and positioned between the guide wheel 212 and the hopper 206. The power source 218 is configured to drive the drive wheel 214 and the paddle assembly 208 for movement of the machine 200 and placement of the pavement material as described herein. The drive wheel 214 is rotatably supported on the frame 204 by an axle 220. The axle 220 supports both the drive wheel 214 and the compactor 210, which in this example is a weighted wheel. As such, drive wheel 214 and the weight wheel rotate in concert during operation of the machine 200. In other examples, the frame 204 may be towed behind or pushed by a vehicle.

Figure 6:
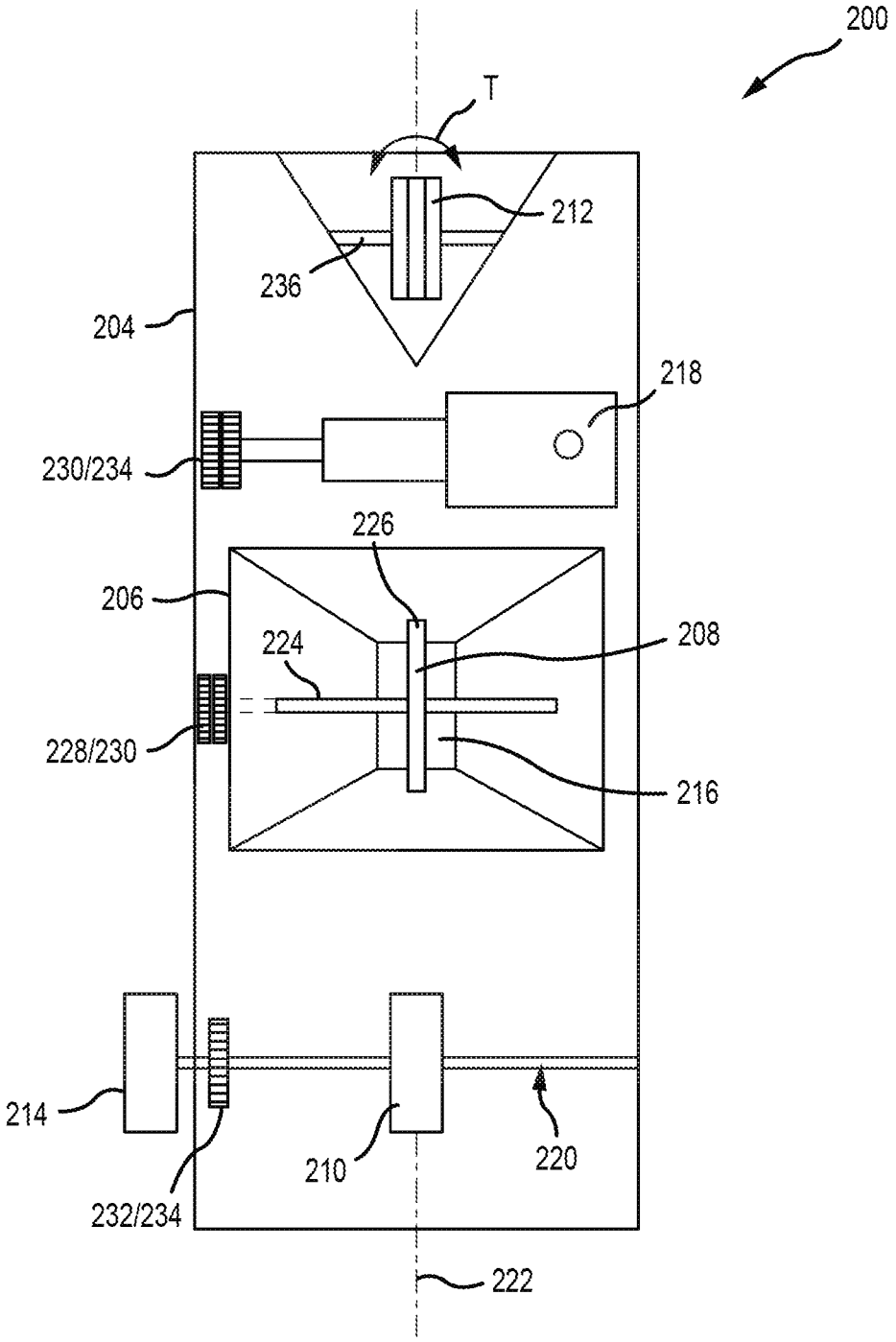
FIG. 6 is a top view of the machine shown in FIG. 5.

FIG. 6 is a top view of the machine 200. Certain components are described above, and thus, are not necessary described further. The frame 204 defines a longitudinal axis 222, in which the guide wheel 212, the outlet opening 216 of the hopper 206, and the compactor 210 are aligned so that the components may be positionable above the trench. The paddle assembly 208 is disposed within the hopper 206 may include a rotatable shaft 224 having a plurality of circumferentially spaced modified paddles 226 extending therefrom and disposed at least partially within the outlet opening 216. Rotation of the shaft 224 is driven by the power source 218 through a transmission 228 that includes one or more sprockets 230 and a drive chain or cable (not shown). The power source 218 also drives rotation of the axle 220 and the drive wheel 214 and the compactor 210 through a transmission 232 that includes one or more sprockets 234 and a drive chain or cable (not shown). In some examples, the transmissions 228, 232 may be independent from one another, while in other examples, the transmissions 228, 232 may be combined as a single unit.

The guide wheel 212 is rotatably mounted on the frame 204 by an axle 236. In the example, the guide wheel 212 freely rotates about the axle 236 and is not coupled to the power source 218. In other examples, the guide wheel 212 may be coupled to the power source 218 and facilitate propelling movement of the machine 200 along the pavement surface. As described above, the guide wheel 212 is configured to follow the contours of the trench and align the hopper 206 and the compactor 210 above the trench. As such, the guide wheel 212 is also freely turnable T about a turn axis that is substantially orthogonal to the longitudinal axis 222.

As illustrated in FIG. 6, the compactor 210 is a weighted wheel that rotates about the axle 220 with the drive wheel 214. In the example, the weighted wheel is substantially equal in size with the drive wheel 214. For example, each wheel may have a 16 inch diameter wheel, although other wheel sizes are also contemplated herein. Additionally or alternatively, the compactor 210 may include a vibrating compactor and/or a hydraulic compactor.

Figure 7:
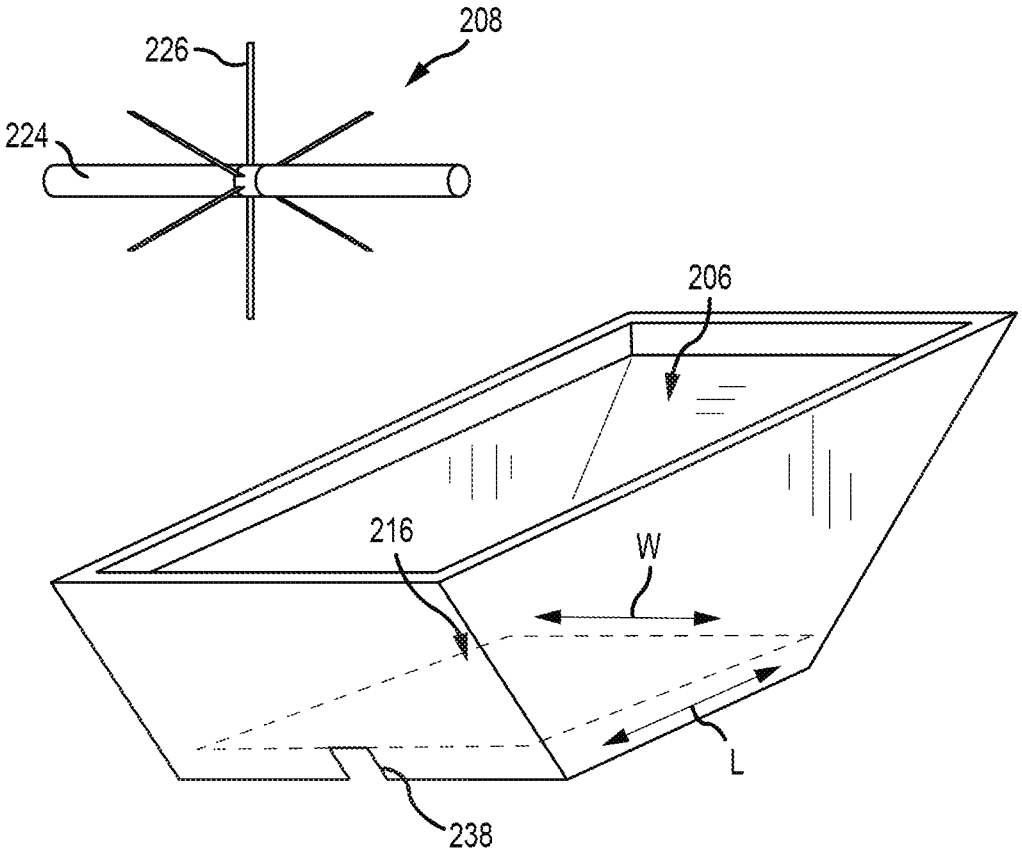
FIG. 7 is an exploded perspective view of a hopper and a paddle assembly of the machine shown in FIG. 5.

FIG. 7 is an exploded perspective view of the hopper 206 and the paddle assembly 208. The paddle assembly 208 includes the shaft 224 that is configured to rotate within the hopper 206 by the power source as described above. The paddles 226 are circumferentially spaced around the shaft 224 and attached to a hub (not shown). The paddles 226 are configured to agitate and break-up the pavement material that is loaded into the hopper 206. Additionally, the paddles 226 may facilitate placement and compaction of the pavement material within the trench. In the example, the paddles 226 are shaped as elongated paddles. In other examples, the paddles 226 may have any other shape that facilitates operation of the paddle assembly 208 as described herein.

The hopper 206 defines the outlet opening 216 at the bottom of the hopper. In this example, the outlet opening 216 is substantially rectangular-shaped. In one example, a length L may be approximately 12 inches and the width W may be between 5 inches and 20 inches. The width W of the outlet opening 216 may at least partially be based on the size of the trench being backfilled so as to reduce overflow of the pavement material out of the trench and subsequent clean-up. In some examples, the width W may be defined by adjustable side hoppers so that the outlet opening 216 can be sized as required or desired. The outlet opening 216 has a downstream end 238 (e.g., the end that is proximate the compactor) that is defined at least partially in the sidewall of the hopper 206. The downstream end 238 enables a uniformed amount of pavement material to be placed over the trench that is then compacted by the compactor that follows.

Figure 8A:
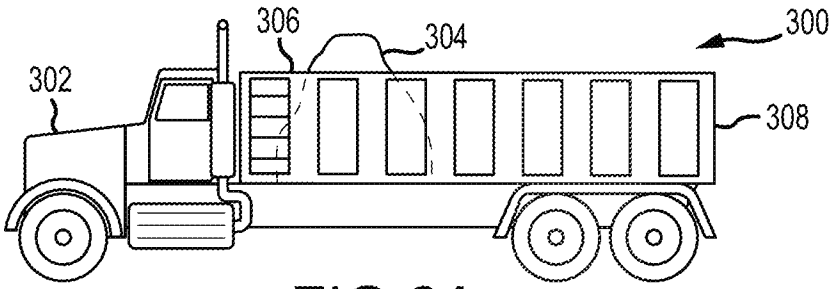
FIGS. 8A-8C are schematic views of an exemplary mobile stockpile.
Figure 8B:
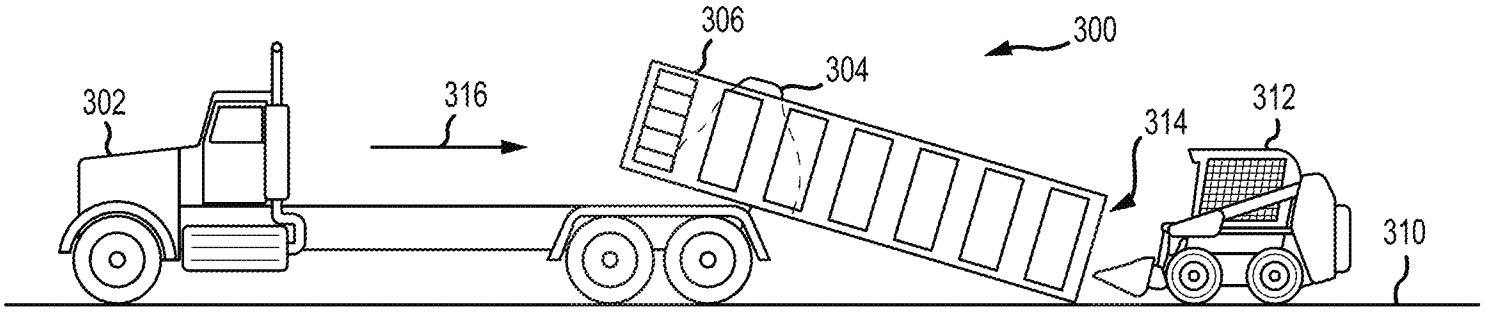
Figure 8C:
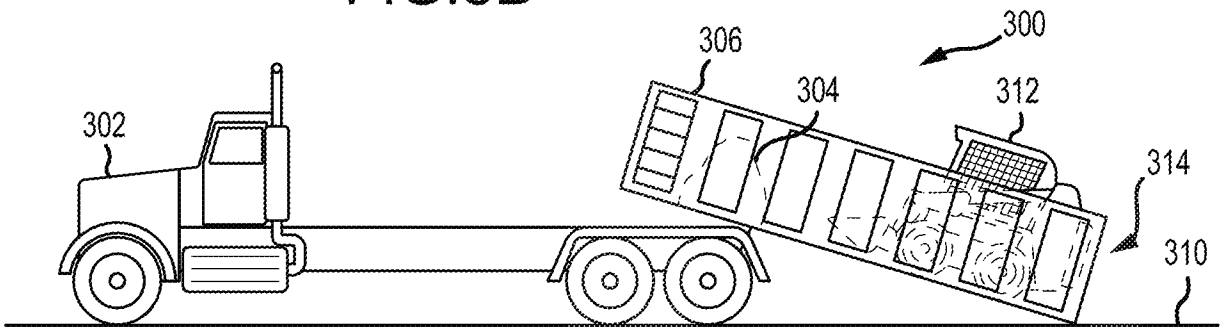

FIGS. 8A-8C are schematic views of an exemplary mobile stockpile 300. The machines described above have a hopper that is configured to receive a load of pavement material and facilitate the above described trench repair operation. In some examples, the pavement material may be stockpiled on-site and in the general area of the trench for loading into the hopper by a skid-steer or wheel-loader in discrete loads. Stockpiling materials on-site, however, requires a large amount of site clean-up after the trench has been repaired. Furthermore, as the machine travels along the trench, the loaders are required to travel further and further between the stockpile and the hopper.

Accordingly, FIG. 8A illustrates a truck 302 that is configured to transport a mobile stockpile 300 to the site and also along the trench during the repair operations. By using the mobile stockpile 300 waste and clean-up of pavement material 304 is reduced or eliminated. The mobile stockpile 300 includes an open-air container 306 (e.g., similar to a roll-off dumpster) with a tailgate 308 configured to hold the stockpile of pavement material 304. The container 306 is configured to be supported on the truck 302 and enables the pavement material 304 to more easily be transported and mobile along the trench. As such, the pavement material 304 is enabled to be moved in close proximity to the machine during operation as required or desired. For example, the truck 302 may follow the machine as it moves along the trench. In other examples, the container 306 may be mounted on a trailer chassis to be pulled by a variety of suitably sized trucks.

In the example, the truck 302 may be a typical heavy-duty, straight chassis commercial truck as illustrated. The chassis configuration may have a single-wheeled, front steering axle and two, dual-wheeled driving axles. In an alternative example, two drop-down single wheeled, booster axles maybe provided to maintain legal axle weights when the container 306 is fully loaded. A smaller example could be mounted on a pickup truck chassis while a larger version could be mounted on a larger truck, or a semi-trailer for use with an independent tractor.

Turning to FIGS. 8B and 8C, the container 306 may be positioned with respect to a pavement surface 310 so that a loader 312 can pick-up a load of pavement material 304 and transfer it to the hopper as required or desired. To accomplish this operation, the tailgate is removed or lowered such that an open side 314 of the container 306 is formed. The container 306 is then lowered 316 to be approximately flush with the pavement surface 310 as illustrated in FIG. 8B. When pavement material 304 is needed for the hopper, the loader 312 can drive at least partially into the container 306, load the pavement material 304, and back-out of the container 306 without any material spilling onto the pavement surface 310. In the example, the width of the container 306 is sized to readily fit the loader 312 therein as illustrated in FIG. 8C. The container 306 may then be mounted back on the truck 302 and moved as required or desired.

The hopper as described above, may be sized as required or desired, for example, so as to require more frequent loader 312 deliveries (e.g., a smaller size hopper), or so as to require less frequent loader 312 deliveries (e.g., a larger size hopper). In alternative examples, the hopper may be loaded by the truck having at least one auger (not shown) extending therefrom. The auger can be configured to selectively channel the pavement material from the truck to the hopper as required or desired. One example of a truck with an auger is the mobile volumetric mixing system described in U.S. patent application Ser. No. 15/804,679, filed Nov. 6, 2017, and titled "VOLUMETRIC CONCRETE MIXING SYSTEM, EQUIPMENT, AND METHOD," which is hereby incorporated by reference in its entirety. In this type system, the mobile volumetric mixing system may be modified to change the storage chambers to store the pavement material, such as asphalt. The mobile system may then move alongside of the machine during repair operations and channel the pavement material into the hopper to further increase efficiencies of the trench repair process.

Figure 9:
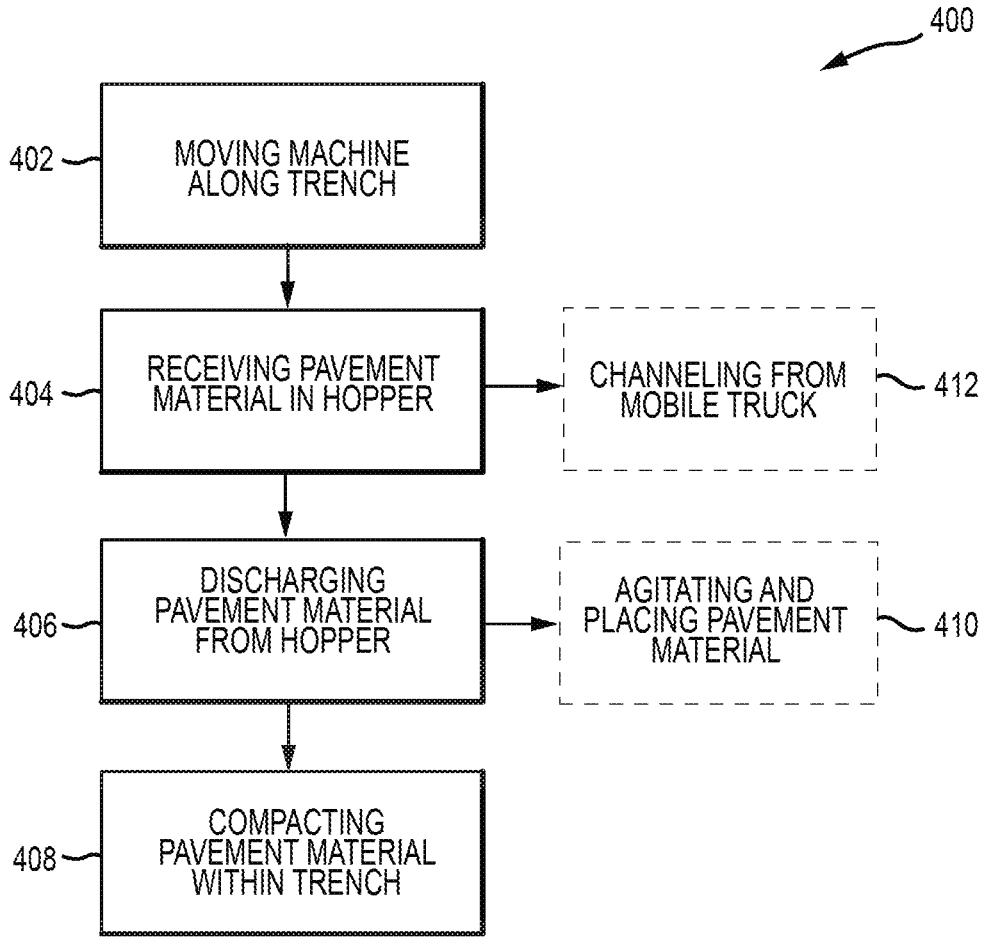
FIG. 9 is a flowchart illustrating an exemplary method of backfilling pavement material into a trench.

FIG. 9 is a flowchart illustrating an exemplary method 400 of backfilling pavement material into a trench. The method 400 includes moving a machine along the trench (operation 402). The machine may include a frame and at least one wheel as described in the examples above. A hopper may be supported on the frame, which receives pavement material therein (operation 404). The pavement material is then discharged from an outlet opening of the hopper into the trench as the machine moves along the trench (operation 406). After the pavement material is placed within the trench, the pavement material is compacted within the trench as the machine moves along the trench (operation 408). For example, the pavement material is compacted and leveled to correspond to the pavement surface.

In some examples, discharging the pavement material from the hopper (operation 406) may include agitating the movement material via a rotatable paddle assembly and placing the pavement material into the trench by the rotatable paddle (operation 410). In another example, receiving the pavement material in the hopper (operation 404) may include channeling the pavement material from a mobile volumetric mixing system (operation 412).

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In this regard, any number of the features of the different embodiments described herein may be combined into one single embodiment and alternate embodiments having fewer than or more than all of the features herein described are possible.

While various embodiments have been described for purposes of this disclosure, various changes and modifications may be made which are well within the scope contemplated by the present disclosure. For example, the hopper may include one or more storage chambers so that further additive materials may be mixed into the pavement material before being placed within the trench. Numerous other changes may be made which will readily suggest themselves to those skilled in the art and which are encompassed in the spirit of the disclosure and as defined in the appended claims.

What is claimed is:

1. A machine for backfilling pavement material into a trench defined within a pavement surface, the machine comprising:

a first frame comprising at least one wheel, wherein the first frame is configured to move along the pavement surface;

a hopper supported on the first frame, wherein the hopper comprises an inlet opening configured to receive pavement material and an outlet opening configured to discharge pavement material into the trench;

a side hopper at least partially surrounding the outlet opening, wherein the side hopper is adjustable to as to adjust a size of the outlet opening;

a second frame pivotably coupled to a rear of the first frame; and a compactor supported on the second frame and configured to compact the discharged pavement material within the trench, wherein the compactor is independently moveable relative to the first frame.

2. The machine of claim 1, wherein the at least one wheel, the hopper, and the compactor are aligned along a longitudinal axis of the machine.

3. The machine of claim 2, wherein the second frame is pivotably coupled to the first frame via a hinged connection, and wherein the hinged connection is oriented substantially orthogonal to the longitudinal axis.

4. The machine of claim 2, wherein the compactor comprises an outwardly extending circumferential flange aligned along the longitudinal axis of the machine.

5. The machine of claim 4, wherein the circumferential flange is configured to extend at least partially into the trench to compact the discharged pavement material within the trench.

6. The machine of claim 2, wherein the outlet opening of the hopper is elongated along the longitudinal axis.

7. The machine of claim 6, wherein the side hopper is adjustable so as to adjust a width of the outlet opening.

8. The machine of claim 6, further comprising a discharge weep sweeper positioned towards a downstream end of the outlet opening.

9. The machine of claim 1, wherein the second frame defines an operator surface configured to support an operator of the machine.

10. The machine of claim 1, further comprising at least one strut coupled between the first frame and the hopper.

11. A machine for backfilling pavement material into a trench defined within a pavement surface, the machine comprising:

a drive wheel configured to propel the machine along the pavement surface;

a hopper comprising an inlet opening configured to receive pavement material and an outlet opening configured to discharge pavement material into the trench;

a guide wheel configured to guide the machine along the trench; and a compactor configured to compact the discharged pavement material within the trench, wherein the drive wheel, the hopper, the guide wheel, and the compactor are all aligned along a longitudinal axis of the machine so that the machine can backfill and compact the trench in a single pass.

12. The machine of claim 11, wherein the drive wheel is positioned between the hopper and the compactor so as to pre-compact the discharged pavement material prior to the compactor.

13. The machine of claim 12, wherein the drive wheel, the hopper, and the guide wheel are supported on a frame, and wherein the compactor is independently moveable relative to the frame.

14. The machine of claim 11, wherein the guide wheel is freely turnable about a turn axis that is substantially orthogonal to the longitudinal axis.

15. The machine of claim 11, further comprising an operator control station at least partially positioned above the drive wheel.

16. The machine of claim 11, wherein the inlet opening of the hopper has a larger cross-sectional area than the outlet opening of the hopper.

17. The machine of claim 11, further comprising a paddle assembly extending at least partially through the outlet opening of the hopper.

18. The machine of claim 17, wherein the paddle assembly comprises a disk having a plurality of circumferentially spaced teeth, and wherein each tooth has a heel and a tip.

* * * * *